US007174824B2

(12) United States Patent
Koskimäki et al.

(10) Patent No.: US 7,174,824 B2
(45) Date of Patent: Feb. 13, 2007

(54) CONTROL VALVE IN A PERCUSSION DEVICE AND A METHOD COMPRISING A CLOSED PRESSURE SPACE AT THE END POSITION OF THE PISTON

(75) Inventors: Antti Koskimäki, Tampere (FI); Markku Keskiniva, Tampere (FI); Jorma Mäki, Mutala (FI); Erkki Ahola, Kangasala (FI)

(73) Assignee: Sahdvik Tamrock Oy, Tampere (FI)

( * ) Notice: Subject to any disclaimer, the term of this patent is extended or adjusted under 35 U.S.C. 154(b) by 0 days.

(21) Appl. No.: 10/546,246

(22) PCT Filed: Feb. 23, 2004

(86) PCT No.: PCT/FI2004/000079

§ 371 (c)(1),
(2), (4) Date: Aug. 19, 2005

(87) PCT Pub. No.: WO2004/073930

PCT Pub. Date: Sep. 2, 2004

(65) Prior Publication Data

US 2006/0175091 A1 Aug. 10, 2006

(30) Foreign Application Priority Data

Feb. 21, 2003 (FI) ..... 20030263

(51) Int. Cl.
*F01L 15/00* (2006.01)
*F01L 31/00* (2006.01)

(52) U.S. Cl. ..... 91/218; 91/236; 91/50; 91/321

(58) Field of Classification Search ..... 91/50, 91/218, 235, 236, 321
See application file for complete search history.

(56) References Cited

U.S. PATENT DOCUMENTS

| | | | | | |
|---|---|---|---|---|---|
| 4,474,248 | A | * | 10/1984 | Musso | 91/319 |
| 4,646,854 | A | * | 3/1987 | Arndt et al. | 91/321 |
| 4,817,737 | A | * | 4/1989 | Hamada et al. | 91/235 |
| 5,392,865 | A | * | 2/1995 | Piras | 91/303 |
| 5,520,254 | A | * | 5/1996 | Weber | 173/128 |
| 5,979,291 | A | | 11/1999 | Juvonen | |

FOREIGN PATENT DOCUMENTS

| | | | |
|---|---|---|---|
| EP | 0578623 | A2 | 1/1994 |
| EP | 0947294 | A2 | 10/1999 |
| GB | 210662 | | 2/1924 |
| WO | 01/92730 | A1 | 12/2001 |

* cited by examiner

*Primary Examiner*—Igor Kershteyn
(74) *Attorney, Agent, or Firm*—Drinker Biddle & Reath LLP

(57) ABSTRACT

The invention relates to a control valve, a percussion device and a method of controlling a working cycle of a percussion device. The percussion device (1) used for breaking rock comprises an impact element (8), which is controlled by a control valve (2). The control valve comprises a control element (5), which is arranged to control channels (7*b*) leading to a working pressure surface (9) of the impact element (8). The movement of the control element to its extreme position is arranged to form a closed pressure space, where pressure medium compresses and converts kinetic energy of the control element into pressure energy. The pressure energy is re-converted into kinetic energy and utilized when the control element changes its direction.

18 Claims, 3 Drawing Sheets

CONTROL VALVE IN A PERCUSSION DEVICE AND A METHOD COMPRISING A CLOSED PRESSURE SPACE AT THE END POSITION OF THE PISTON

BACKGROUND OF THE INVENTION

The invention relates to a control valve, which is movable back and forth and arranged to open and close pressure channels leading to a percussion device. Furthermore, the invention relates to a method of controlling a working cycle of a percussion device, and to a percussion device for breaking rock.

In rock breaking, percussion hammers and rock drills are used that are equipped with a percussion device for giving impact pulses to the rock through a tool. The percussion device comprises an impact element, such as an impact piston, whose working pressure surfaces can be affected by a pressure medium, the impact element being arranged to produce the necessary impact pulses. The pressure medium that acts on the impact element can be guided by a control valve, which is connected to open and close pressure medium channels. It has been found that particularly when the control valve has to be able to open and close very fast, a high amount of kinetic energy binds to the valve due to the valve mass and velocity. Thus a problem associated with existing control valves is that their use requires a high amount of power.

BRIEF DESCRIPTION OF THE INVENTION

The object of the invention is to provide a novel and improved control valve and percussion device and a method for implementing a working cycle of a percussion device.

The control valve of the invention is characterized in that when the control element is moved in a first control direction from the middle position towards a first extreme position, the second working pressure space is arranged to close and form a closed pressure space, and correspondingly, when the control element is moved in the second control direction from the middle position towards a second extreme position, the first working pressure space is arranged to close and form a closed pressure space; that the pressure medium in the closed pressure space is arranged to compress and convert kinetic energy of the control element into pressure energy; and that the pressure energy in the closed pressure space is arranged to be re-converted into kinetic energy when the control element changes its direction.

The method according to the invention is characterized by forming a closed pressure space in a second working pressure space when the control element is moved in the first control direction towards the extreme position; by forming a closed pressure space in the first working pressure space when the control element is moved in the second control direction towards the extreme position; by compressing the pressure medium in the closed pressure space and converting kinetic energy of the control element into pressure energy, and by re-converting the pressure energy in the closed pressure space into kinetic energy when the control element changes its direction.

The percussion device according to the invention is characterized in that when the control element of the control valve is moved in the first control direction from the middle position towards a first extreme position, the second working pressure space is arranged to close and form a closed pressure space, and correspondingly, when the control element is moved in the second control direction from the middle position towards a second extreme position, the first working pressure space is arranged to close and form a closed pressure space; that the pressure medium in the closed pressure space is arranged to compress and convert kinetic energy of the control element into pressure energy; that the pressure energy in the closed pressure space is arranged to be re-converted into kinetic energy when the control element changes its direction; and that the control valve is arranged to execute its working cycle without external control.

The basic idea underlying the invention is that a control valve includes a control element, which can be moved back and forth in a first control direction and in a second control direction and which is arranged to guide pressure medium flows to be led through the control valve to one or more working pressure surfaces of an impact element or away from them. Furthermore, a closed pressure space is arranged to be formed in the control valve both in the first and in the second control direction when the control element approaches its extreme positions. In that case, the pressure medium in the closed pressure space compresses and stores kinetic energy of the control element as pressure energy. The pressure energy is re-converted into kinetic energy when the control element changes its direction at its extreme positions.

An advantage of the invention is that the valve requires no external control but the valve may repeat its working cycle as long as pressure medium is fed into it. Thus the controlling of the percussion device working cycle is simple. Furthermore, the structure of the control valve may be relatively simple. A further advantage of the control valve according to the invention is that the power needed to operate the control valve may be relatively low regardless of the fact that the operating frequency of the control valve is high.

The basic idea underlying an embodiment of the invention is that the control element is arranged to open two or more parallel pressure medium channels substantially simultaneously when the control element is moved in the first control direction and/or in the second control direction. In that case, the pressure medium can flow along two or more channels to one or more working pressure surfaces of the percussion device to produce an impact pulse. The flow direction of the pressure medium is the same in parallel channels. In addition, in some embodiments of the percussion device, the pressure medium can be guided away from the working surface of the percussion device by means of the control element along several parallel channels into a discharge channel, as a result of which an impact pulse is produced.

The basic idea underlying an embodiment of the invention is that one back and forth movement of the control element, i.e. one working cycle, is arranged to open and close pressure medium channels so that several impact pulses per one working cycle of the valve are produced in the percussion device. For example, the percussion device may be arranged to produce 2, 4 or 6 impact pulses per a working cycle of the control valve. When the working cycle of the control valve includes several connecting moments, the operating frequency of the valve may be several times lower than the operating frequency of the percussion device. At a connecting moment, the pressure medium flow may be arranged in one direction towards the percussion device or away from it. Alternatively, at the connecting moment, the pressure medium may be arranged to flow towards the percussion device along first channels and away from the percussion device along second channels. Thus the control valve is arranged to open a connection between two or more pressure medium channels at the connecting moment.

The basic idea underlying an embodiment of the invention is that the control valve comprises a frame and a sleeve-like control element. The control element is arranged in a space in the frame and it can be moved in the control direction. Several working pressure surfaces are provided on the outer periphery of the control element, which are located in the working pressure spaces surrounding the control element. The control element can be moved by affecting the pressure of the pressure medium in the working pressure spaces, which also affects the pressure acting on the working pressure surfaces. In addition, the control element comprises one or more apertures extending from the outer surface of the sleeve to its inner surface. By moving the control element, the apertures can be directed at the pressure medium channels provided in the frame and away for guiding pressure medium flows.

The basic idea underlying an embodiment of the invention is that there is a shoulder on the outer periphery of the control element, which is arranged to open and close the connection from the working pressure spaces of the control element to the discharge channel when the control element is moved. Furthermore, the movement of the control element in a control direction is arranged to open and close a connection from the first control pressure channel to the first working pressure space. Correspondingly, the movement of the control element in a control direction is arranged to open and close a connection from a second pressure control channel to a second working pressure space. There are recesses provided on the outer periphery of the sleeve on both sides of the shoulder. Thanks to the recesses, the volume of the working pressure spaces is greater, in which case a larger amount of pressure energy can be stored in them.

The basic idea underlying an embodiment of the invention is that a frame portion is arranged inside the sleeve-like control element. The frame portion is provided with auxiliary spaces, which are connected to the working pressure spaces by means of connecting channels. The purpose of the auxiliary spaces is to increase the volume of the working pressure spaces. When the working pressure spaces have a sufficiently great volume, a sufficient amount of pressure energy can be stored in them, which can be utilized for moving the control element.

The basic idea underlying an embodiment of the invention is that the control element is an elongated object, which is moved back and forth longitudinally.

The basic idea underlying an embodiment of the invention is that the control element comprises a periphery or a portion of a periphery and that the control element is moved back and forth in the direction of the periphery.

The basic idea underlying an embodiment of the invention is that a substantially constant pressure medium pressure is fed into the control pressure channels of the control valve.

The basic idea underlying an embodiment of the invention is that the pressure medium is hydraulic fluid.

BRIEF DESCRIPTION OF THE FIGURES

The invention will be described in greater detail in the accompanying drawings, in which.

For the sake of clarity, the figures show the invention in a simplified manner. Like reference numbers identify like elements.

DETAILED DESCRIPTION OF THE INVENTION

Figure 1:
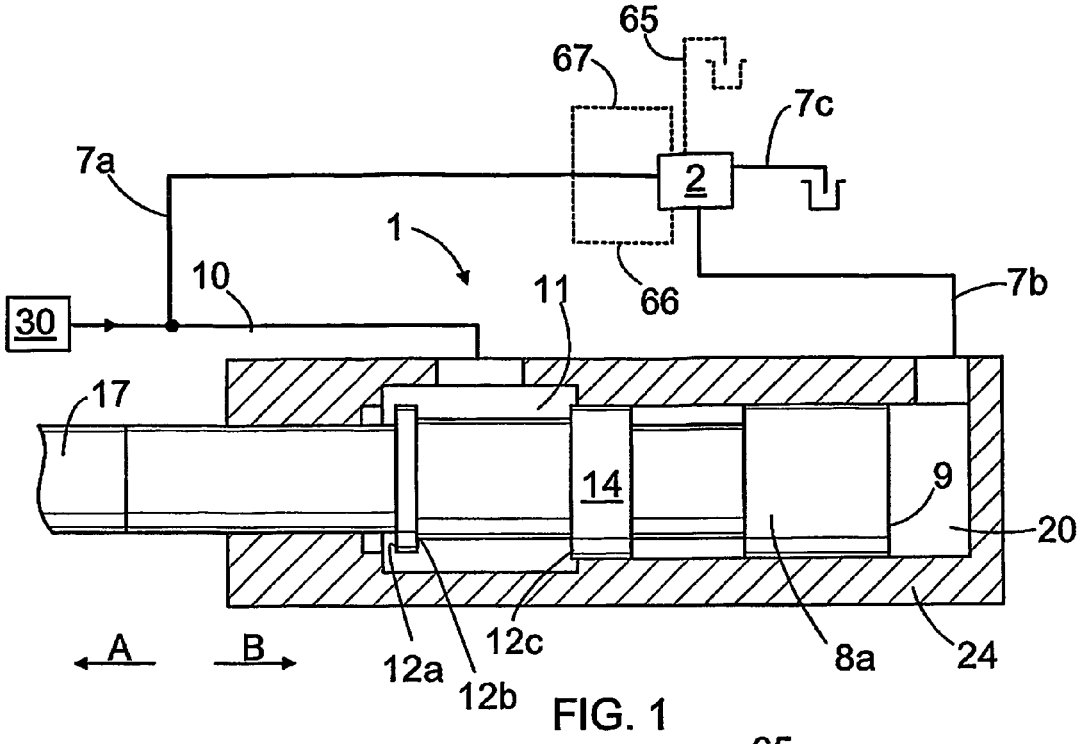
FIG. 1 is a schematic cross-sectional view of a percussion device in a situation where a percussion piston is about to be returned for a new stroke.
Figure 2:
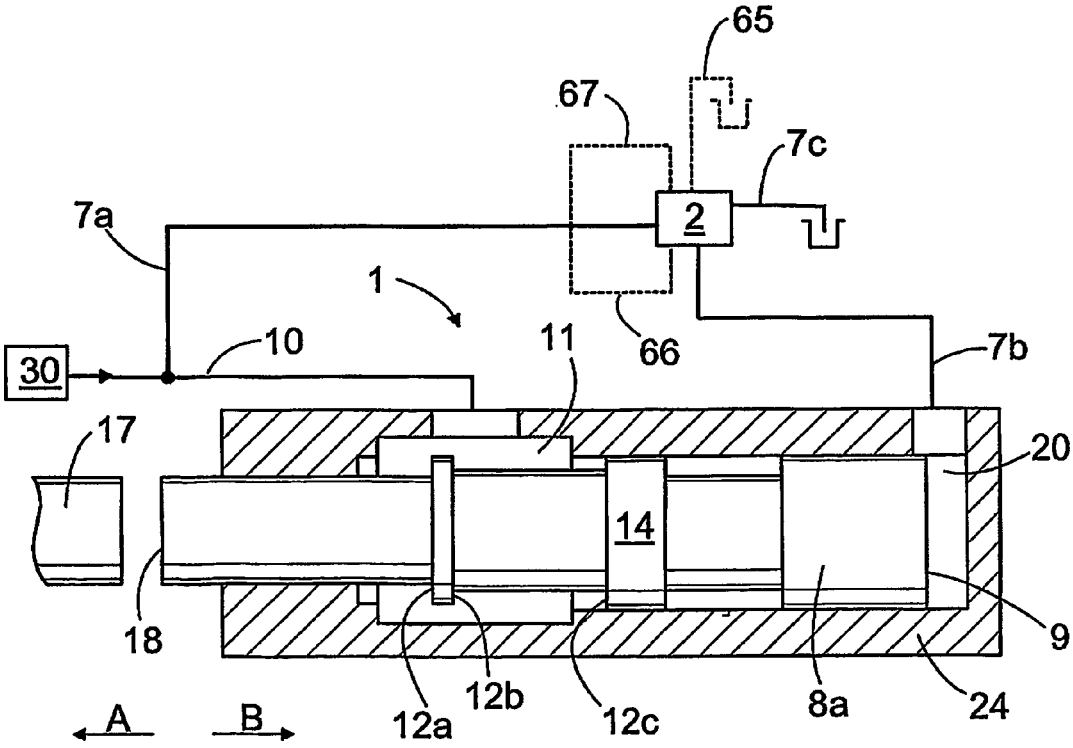
FIG. 2 is a schematic cross-sectional view of the percussion device of FIG. 1 in a situation where a percussion piston starts an impact movement.

FIGS. 1 and 2 illustrate the structure and operating principle of a percussion device 1. In this case, the percussion device 1 comprises a percussion piston 8*a*, which can be moved back and forth in an impact direction A and in a return direction B by means of pressure medium and whose impact surface 18 is arranged to strike a tool 17 provided in front of the impact piston 8*a* and produce an impact pulse in the tool 17 for breaking rock. The impact piston 8*a* thus functions as an impact element 8 which produces impact pulses. A working cycle of the impact piston 8*a* can thus be controlled by controlling the pressure medium in a pressure space 20 affecting the impact piston 8*a* by means of a control valve 2. In some embodiments, it is also possible to control the pressure acting on other pressure spaces, e.g. pressure space 11. The pressure medium is typically hydraulic fluid.

In FIG. 1, the impact piston 8*a* has just struck the tool 17 and the impact piston 8*a* is about to be returned for a new stroke in the return direction B. The control valve 2 has opened a connection from the pressure space 20 at the rear end of the impact piston 8*a* to a channel 7*c* leading to a tank, in which case substantially no pressure medium pressure acts on the working pressure surface 9 at the rear end of the impact piston 8*a*. There is a connection from a pressure source 30 to a pressure space 11 around the impact piston 8*a* through a channel 10, in which case the pressure of the pressure medium acts on working surfaces 12*a* to 12*c* of the impact piston 8*a*, which are dimensioned so that the impact piston 8*a* starts the return movement in direction B.

In FIG. 2, the impact piston 8*a* is about to start an impact movement in the impact direction A. The control valve 2 has opened a connection from channel the 7*a* to the channel 7*b* and further to the pressure space 20, in which case the pressure of the pressure medium fed from the pressure source 30 acts on the working pressure surface 9. The working pressure surfaces in the impact direction A are clearly larger than the working pressure surfaces acting on the impact piston 8*a* in the return movement B, in which case the impact piston 8*a* starts to move towards the tool 17 with high acceleration and strikes it. In the solutions shown in FIGS. 1 and 2, the position of the impact piston can be detected by suitable means, and the detection information can be used for controlling the working cycle of the impact piston.

It is completely clear to a person skilled in the art that the percussion device 1 can also be implemented differently from what is exemplified in FIGS. 1 and 2. The impact element 8 may comprise various shoulders and working pressure surfaces. Furthermore, the control valve 2 may be arranged to guide pressure medium to all working pressure surfaces or only to some working pressure surfaces.

Figure 3:
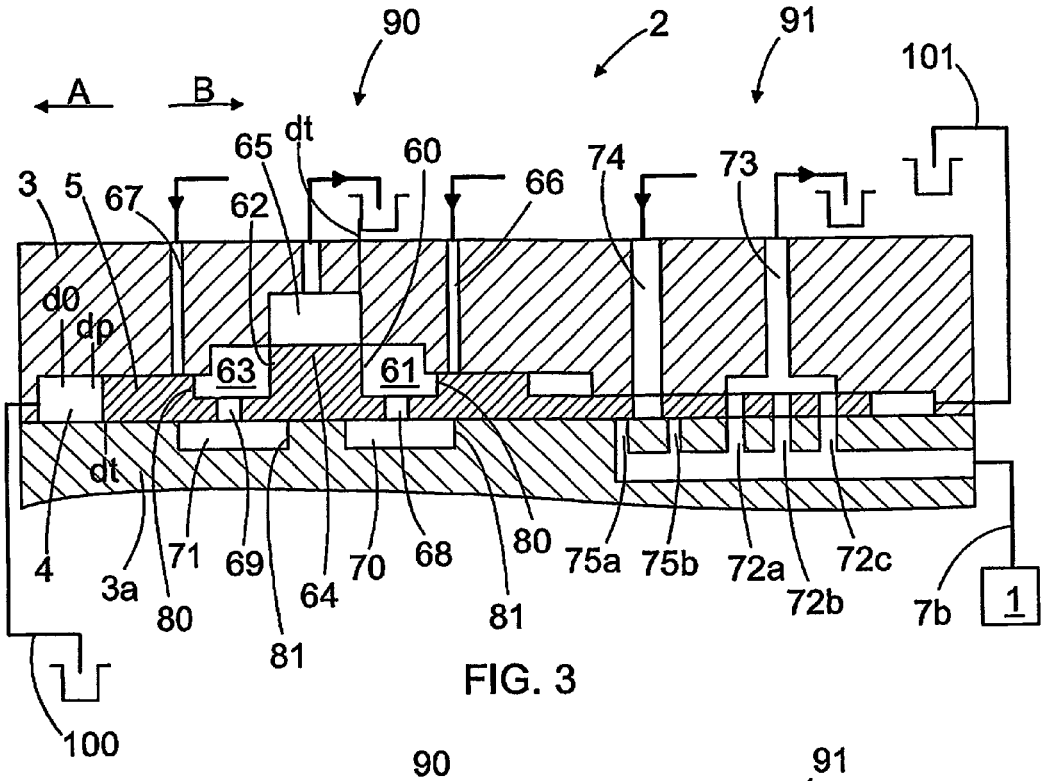
FIG. 3 is a schematic cross-sectional view of a control valve according to the invention.

FIG. 3 illustrates an embodiment of the control valve 2 according to the invention. The means related to the use of the control valve 2 may be arranged in an operating part 90 formed in the first end of the valve, and the means related to the controlling of the pressure medium, i.e. connecting means, may be arranged in a control part 91 formed in the second end of the valve. The control valve 2 comprises a frame 3 and a control element 5. The control element 5 may be an elongated sleeve-like object, which can be moved in the axial direction with respect to the frame 3. The control element 5 may comprise a first working pressure surface 60, which acts in direction A and is connected to a first working pressure space 61 of the control valve 2. Furthermore, the control element 5 may comprise a second working pressure surface 62, which acts in direction B and is connected to a second working pressure space 63 of the control valve 2. The outer periphery of the control element 5 may be provided with a shoulder 64, which may open or close a connection from the working pressure spaces 61, 63 to a discharge channel 65 when the control element 5 is moved in the axial direction. In addition, the movement of the control element 5 in the axial direction is arranged to open and close a connection from a first control pressure channel 66 to the first working pressure space 61. Correspondingly, the control element 5 may be arranged to open and close a connection from a second control pressure channel 67 to the second working pressure space 63. As appears from FIG. 3, there may be recesses on both sides of the shoulder 62 on the outer periphery of the sleeve. Thanks to the recesses, the volume of the working pressure spaces 61 and 63 is greater. In addition, the working pressure spaces 61 and 63 may be connected to auxiliary spaces 70 and 71 optionally formed in the frame portion 3*a* inside the sleeve through connecting channels 68 and 69. The purpose of the auxiliary spaces 70 and 71 is to increase the volume of the working pressure spaces 61 and 63. In some cases, only the recesses 80 provided in the control element 5, or alternatively only the auxiliary spaces 70, 71, may sufficiently increase the volume of the working pressure spaces 61, 63. When the working pressure spaces 61, 63 have a sufficiently great volume, pressure energy can be stored in them for use in the axial movement of the control element 5, as will be described later. FIG. 3 shows the control element 5 in a middle position, from which it can be moved in direction A to its first extreme position and correspondingly in direction B to its second extreme position. Thus the control element 5 can perform a control function in both extreme positions as well as in the middle position.

The control element 5 according to FIG. 3 may include several parallel discharge channels 72*a* to 72*c*, along which pressure medium can flow from the percussion device 1 to a channel 73 leading to a tank when the control element 5 is in the middle position. If the control element 5 is moved from the middle position in direction A or B, the connection from the parallel discharge channels 72*a* to 72*c* to channel 73 will be closed. At the same time, a connection opens from the pressure channel 74 to a working pressure channel 75*a* or 75*b*. Consequently, the working cycle of the control valve 2 shown in FIG. 3 comprises several connecting moments. When the control valve 2 of FIG. 9 moves from the first extreme position to the second extreme position, two control functions may take place during this one-way movement from left to right: in the first extreme position the pressure medium can flow to the percussion device 1 along the pressure medium channel 75*a*; in the middle position the pressure medium can flow away from the percussion device 1 along the parallel discharge channels 72*a* to 72*c* into the tank; and in the second extreme position pressure medium is fed into the percussion device 1 along the channel 75*b*. The control valve 2 may be connected to the percussion device 1 so that one axial movement of the control element 5 in direction A or B produces one impact pulse in the percussion device 1. In that case, the operating frequency of the percussion device 1 may be double compared to the operating frequency of the control valve 2. If the working cycle of the control valve is provided with several connecting moments, even a higher number of strokes can be produced in the percussion device per one working cycle of the control valve 2. In that case, the ratio of the operating frequency of the control valve 2 may be even smaller compared to the impact frequency of the percussion device 1, for example one fourth, one sixth, etc. The number of parallel discharge channels 72*a* to 72*c* which open substantially simultaneously can be selected so that the parallel channels together form a sufficiently large cross section area, which allows quick conveyance of the necessary flow through the valve.

The control valve 2 illustrated in FIG. 3 may be arranged to change its position independently without any external control. When the control element 5 is in the first extreme position, i.e. has moved to the left, the second working pressure space 63 is connected to the second control pressure channel 67. Since in this case the first working pressure space 61 is connected to the discharge channel 65, a force acts on the control element 5, trying to move the element in direction B. At the same time, pressure energy is stored in the second working pressure space 63 and in the auxiliary space 71 belonging to it. When the control element 5 moves from the extreme position d0 in direction B to a predetermined point dp, the connection from the second control pressure channel 67 to the second working pressure space 63 is closed. In this situation, the connection from the second working pressure space 63 to the discharge channel 65 is still closed. The pressure energy stored in the second working pressure space 63 makes the control element 5 continue its movement in direction B. This means that the compressed pressure medium in the second working pressure space 63 expands so that the pressure energy is converted into kinetic energy. When the control element 5 reaches the predetermined point dt, the shoulder 64 opens a connection from the second working pressure space 63 to the discharge channel 65. When the control element 5 moves further in direction B past the middle position, the shoulder 64 closes the connection from the first working pressure space 61 to the discharge channel 65. As a result of this, the pressure rises in the first working pressure space 61 as the control element 5 moves further to the right. When the control element 5 continues moving in direction B, a connection opens from the first working pressure space 61 to the first control pressure channel 66. In that case, some of the pressure medium acting on the first working pressure space 61 may penetrate into the first control pressure channel 66. The kinetic energy of the control element 5 decreases constantly as the control element moves towards its extreme position. Finally, the force acting on the first working pressure surface 60 of the control element 5 stops the control element 5 and makes it change its direction. Then the control element 5 starts to accelerate its speed in the opposite direction A. Since the structure and function of the control valve are symmetric in both directions, the steps described above are repeated. The control element 5 continues the back and forth movement without external control as long as pressure medium is fed into the control pressure channels 66 and 67.

In the control valve 2 according to the invention, the movement of the control element 5 in the extreme positions can be dampened by closed pressure spaces. Thus the control element 5 is not stopped mechanically, and thanks to this, the axial surfaces of the frame 3 and the control element 5 are not subjected to wearing mechanical stress.

Furthermore, the control valve 2 may include means for ensuring that the control element 5 does not stay in its middle position when the valve 2 is stopped. These means are arranged to affect the control element 5 so that it moves to one of its extreme positions, and when the pressure of pressure medium is guided to the valve 2 again, it starts to move back and forth according to its working cycle. FIG. 3 illustrates a solution where connections have been established from the spaces at the ends of the control element 5 to the tank along channels 100 and 101.

The recesses 80 and 81 in the control valve 2 can also be constructed otherwise. For example, some solutions may lack recesses 80 altogether, in which case only the auxiliary spaces 70 and 71 are arranged to enlarge the control pressure spaces 61 and 63 in the desired manner. Furthermore, the shoulder 64 can be provided on the inner periphery of the sleeve and control pressure spaces 61 and 63 and optional recesses can be formed inside the sleeve. In that case, the auxiliary spaces 70, 71 may be formed on the outer periphery of the sleeve.

Figure 4:
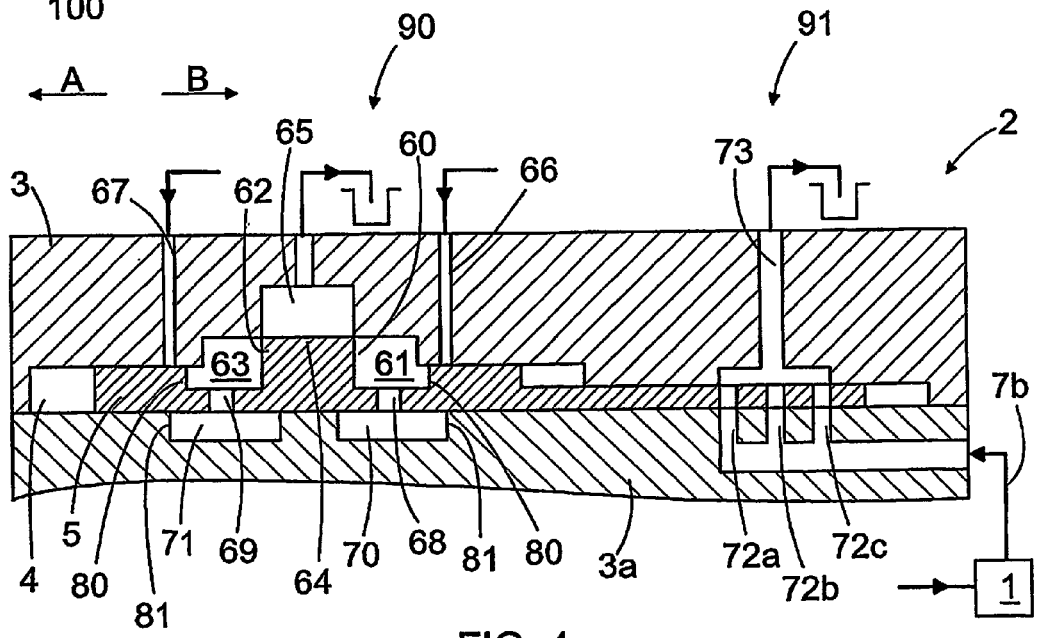
FIG. 4 is a schematic cross-sectional view of another control valve according to the invention.

The control valve 2 shown in FIG. 4 is arranged to move back and forth between its extreme positions in a manner which corresponds to that of the control valve shown in FIG. 3. The difference between this solution and the one illustrated in FIG. 3 is that the control element 5 is arranged to only open and close parallel discharge channels 72*a* to 72*c* for conveying pressure medium from the percussion device 1 to the channel 73 leading to the tank. The percussion device 1 may be constantly connected to the pressure source from which pressure medium is fed to one or more working pressure surfaces in the impact element. The impact pulses needed to break rock can be produced by quickly discharging the pressure medium acting on the impact element to the tank.

Furthermore, it is feasible to form a control valve 8 according to the inventive concept where one back and forth movement of the control element 5 is arranged to open and close pressure medium channels so that several impact pulses are produced in the percussion device 1, for example 2, 4 or 6 impact pulses per a working cycle of the valve. This way the operating frequency of the control valve 8 can be reduced. On the other hand, by using a control valve which enables several impact pulses per a valve working cycle, the impact frequency of the percussion device 1 can be increased without the operating frequency of the control valve 8 constituting a restrictive factor. The movement of the control element 5 in the control direction can be dimensioned according to the number of connecting moments in a valve working cycle: the higher the number of connecting moments is, the longer the movement of the control element 5 may be. In addition, since the speed of the control element 5 may differ at different connecting moments, the size of the channels formed in the frame 3 of the control valve can be dimensioned so that the channel is open for a substantially equal time at each connecting moment.

Since the control valve 2 according to the invention requires no external control, it is simple to control the working cycle of the percussion device 1, and the structure of the control valve 2 may be relatively simple. In addition, the operation of the control valve 2 can be affected in various ways by dimensioning the above-mentioned opening points dp and dt appropriately, and by affecting the pressure acting on the control pressure channels 66 and 67. Another advantage of the solutions illustrated in FIGS. 3 and 4 is that their pressure losses are small. This results from the fact that the points dp and dt can be dimensioned so that the connection from the control pressure channels 66 and 67 does not open to the working pressure spaces 61 and 63 until the pressure acting on the working pressure spaces 61 and 63 has risen to correspond to the pressure acting on the control pressure channels 66 and 67 due to the movement of the control element 5. Furthermore, the points dp and dt can be dimensioned so that the connection from the working pressure spaces 61 and 63 to the discharge channel 65 does not open until the pressure in the working pressure channels 61 and 63 has decreased so that it substantially corresponds to the pressure in the tank.

Instead of the sleeve shown in FIGS. 3 and 4, the control element 5 may be another kind of object that can be moved longitudinally. The control element 5 may be, for example, a slide or a pin, in which case the control valve 2 may be a spool valve. Also in this case, the control element 5 may have a middle position and a first and a second extreme position. Parallel pressure/discharge channels may be arranged to be connected in the middle or in the extreme position of the control element 5. Furthermore, if the working cycle of the control valve 2 comprises several connecting moments, one or more connecting moments may be arranged between the middle position and the extreme position.

The control valve, whose control element is arranged to move between the middle position and the extreme positions, may, depending on the structure of the percussion device, be arranged to guide the pressure medium flow along parallel channels either away from the working pressure surface of the impact element or to the working pressure surface for the production of an impact pulse.

Figure 5:
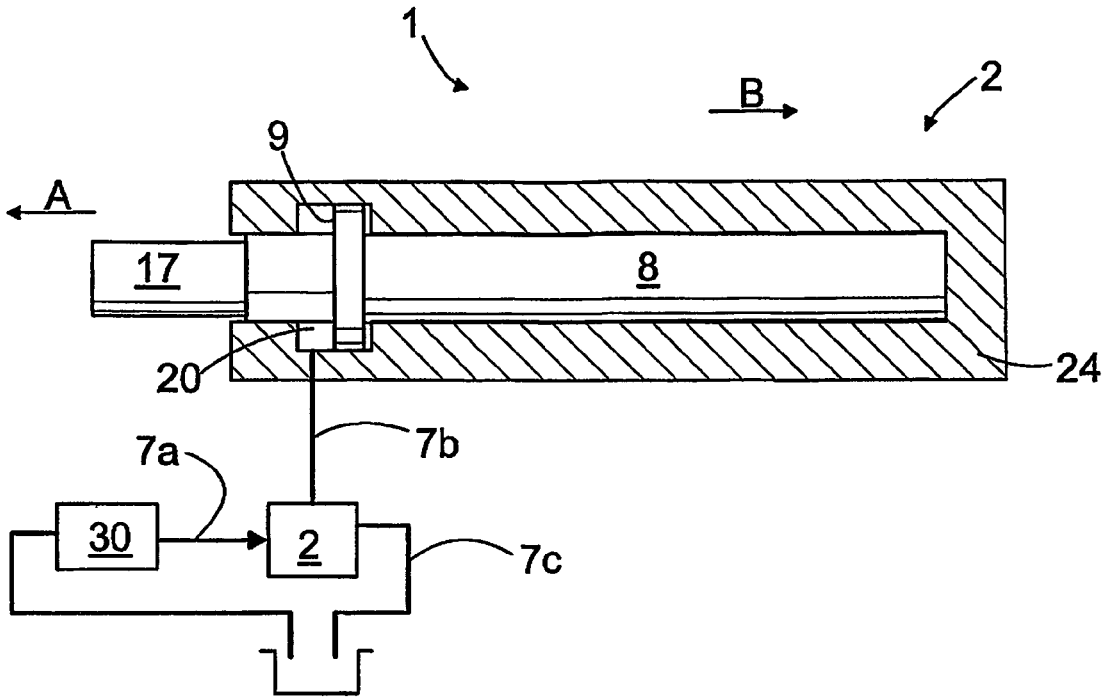
FIG. 5 is a schematic cross-sectional view of a percussion device where a sudden discharge of pressure medium from a pressure surface of an impact element is arranged to produce an impact pulse, and FIG. 6 schematically illustrates part of a control valve of the invention from one end, where the control element of the control valve is an object that can be moved back and forth in the direction of the periphery.

FIG. 5 shows a considerably simplified "compression bar percussion device". In this kind of percussion device 1, the impact element is not moved back and forth by means of pressure medium but impact pulses are produced by changing the pressure of the pressure medium on the pressure surface 9 of the impact element 8. The pressure of pressure medium is conveyed into the working pressure space 20 by means of the control valve 2, which makes the impact element 8 move against the frame 24 in direction B and compress. In this embodiment, the impact element 8 functions as a compression bar. When the pressure acting on the pressure surface 9 of the impact element is discharged quickly from the working pressure space 20 by means of the control valve 2, the impact element 8 resumes its original length and produces an impact pulse in the tool 17. The control valve 2 of the invention needs no external control, for which reason it is simple to install in percussion devices 1 of this kind, too. In addition, the energy consumption of the control valve 2 according to the invention is clearly smaller than that of conventional valves, which naturally improves the operating efficiency of the percussion device 1. Furthermore, a control valve 2 provided with several connecting moments per a valve working cycle may also be used. In that case, the compression bar percussion device can be provided with a very high impact frequency. The operating frequency of the control valve 2 may, however, be several times lower than the impact frequency of the percussion device.

The control valve according to the invention also enables the conveyance of pressure pulses directly from the pressure container to the working pressure surface of the impact element for the production of impact pulses.

Figure 6:
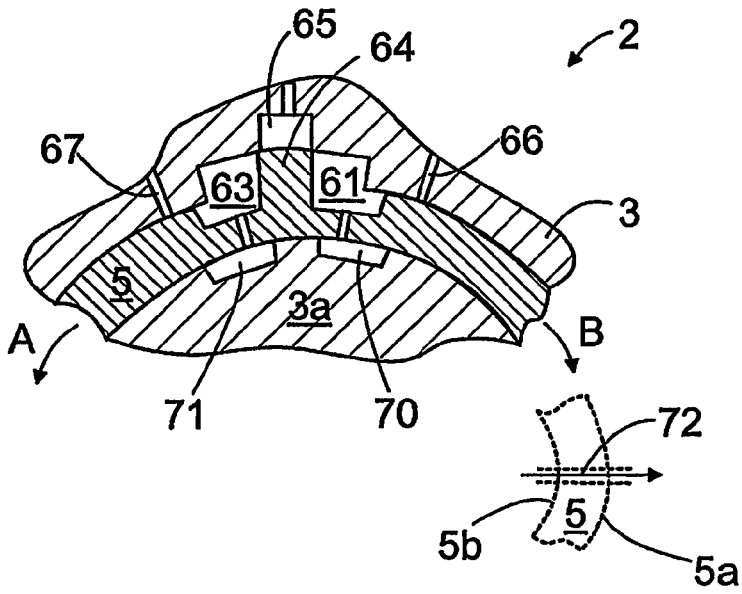

FIG. 6 illustrates part of a control valve 2 according to the invention, whose control element 5 is an object which is movable back and forth in the direction of the periphery. The control element 5 may be, for example, a sleeve or it may have the cross-sectional shape of an annulus sector. In that case, the control element 5 has an outer periphery 5*a* and an inner periphery 5*b*. The control element 5 can be moved back and forth in control directions A and B according to its working cycle. The control element 5 can be moved according to the same principle as the control element 5 shown in FIGS. 3 and 4, which is moved longitudinally. According to the inventive concept, closed pressure spaces are formed when the control element 5 moves from the middle position shown in FIG. 6 towards either of the extreme positions. In that case, kinetic energy of the control element 5 may be converted into pressure energy in the closed pressure space. The control element 5 may be arranged to open and close one or more pressure medium channels 72. The control element 5 may also be provided with several parallel pressure medium channels, which open substantially simultaneously and where the flow direction is the same. This kind of control valve 2 may also be provided with recesses and auxiliary spaces 70, 71. One or more of the means shown in FIG. 6 for forming closed pressure spaces may be arranged on the outer periphery 5*a* of the control element 5. In some cases, the means for forming closed pressure spaces can also be arranged on the inner periphery 5*b* of the control element 5.

It should still be noted that the control valve of the invention is also applicable in other kind of percussion devices intended for rock breaking. It is not the production technique of impact impulses in the percussion device or the device used for breaking rock that is relevant to the invention but the controlling and structure of the control valve working cycle.

The drawings and the related description are only intended to illustrate the inventive concept. The details of the invention may vary within the scope of the invention.

The invention claimed is:

1. A control valve for controlling a working cycle of a percussion device, the valve comprising:

a frame including a space;

at least two pressure medium channels connected to the space;

a control element, which is arranged in the space in the frame, which is movable back and forth in a first control direction and in a second control direction and which is further arranged to open and close the pressure medium channels when the control element is moved back and forth according to its working cycle;

at least a first working pressure space and at least a second working pressure space;

a first control pressure channel for feeding pressure medium into a first working pressure space when the control element changes its direction;

a second control pressure channel for feeding pressure medium into the second working pressure space when the control element changes its direction;

at least a first working pressure surface, which is arranged to move the control element in the first control direction due to the influence of the pressure medium acting on the first working pressure space;

and further comprising at least a second working pressure surface, which is arranged to move the control element in the second direction due to the influence of the pressure medium acting in the second working pressure space;

and when the control element is moved in the first control direction from the middle position towards a first extreme position, the second working pressure space is arranged to close and form a closed pressure space, and correspondingly, when the control element is moved in the second control direction from the middle position towards a second extreme position, the first working pressure space is arranged to close and form a closed pressure space;

the pressure medium in the closed pressure space is arranged to compress and convert kinetic energy of the control element into pressure energy;

and the pressure energy in the closed pressure space is arranged to be re-converted into kinetic energy when the control element changes its direction.

2. A control valve according to claim 1, wherein the control element is an elongated sleeve including an outer periphery and an inner periphery, the working pressure spaces are formed around the control element in the space in the frame, and a first recess is formed on the outer periphery of the control element at the first working pressure space, and correspondingly, a first recess is formed at the second working pressure space to increase the volume of the working pressure spaces.

3. A control valve according to claim 1, wherein the control element is an elongated sleeve provided with an outer periphery and an inner periphery, inside the control element there is a frame portion, which is arranged immovably with respect to the frame and comprises an outer periphery, the control element is arranged movably in an annular space between the frame and the frame portion, a second recess is formed on the outer periphery of the frame portion at the first working pressure space, and correspondingly, a second recess at the second working pressure space, an auxiliary space is arranged to be formed between the inner periphery of the control element and the second recess, and there is a connecting channel between the working pressure space and the second recess for connecting the auxiliary space to the working pressure space.

4. A control valve according to claim 1, wherein the control valve includes least two parallel pressure channels where the flow direction of the pressure medium is the same, and the movement of the control element in one control direction is arranged to open a connection from the parallel pressure channels through the control valve substantially simultaneously.

5. A control valve according to claim 1, wherein the working cycle of the control valve is provided with a plurality of connecting moments for opening and closing the pressure channels, and one working cycle of the control valve from the first extreme position to the second extreme position and back is arranged to produce at least two impact pulses in the percussion device.

6. A control valve according to claim 1, wherein
the control element is an elongated object,
and the control element is movable back and forth longitudinally in the first control direction and in the second control direction.

7. A control valve according to claim 1, wherein
the control element comprises a periphery or a portion of a periphery,
and the control element is movable back and forth in the direction of the periphery in the first control direction and in the second control direction.

8. A method of controlling a working cycle of a percussion device, the method comprising:
guiding the pressure of pressure medium onto at least one working pressure surface of an impact element provided in the percussion device to produce an impact pulse;
using at least one control valve for guiding the pressure medium, the control valve including at least a frame and a control element;
moving the control element back and forth in a first control direction and in a second control direction according to its working cycle,
opening and closing pressure medium channels leading to the percussion device according to the working cycle of the control element;
leading pressure medium onto a first working pressure surface in connection with a first working pressure space in the control element in order to move the control element in the first control direction;
and leading pressure medium onto a second working pressure surface in connection with a second working pressure space in the control element in order to move the control element in the second control direction;
forming a closed pressure space in the second working pressure space when the control element is moved in the first control direction towards the extreme position;
forming a closed pressure space in the first working pressure space when the control element is moved in the second control direction towards the extreme position;
compressing the pressure medium in the closed pressure space and converting kinetic energy of the control element into pressure energy;
and re-converting the pressure energy in the closed pressure s ace into kinetic energy when the control element changes its direction.

9. A method according to claim 8, comprising
producing several impact pulses per one working cycle of the control valve in the percussion device.

10. A method according to claim 8, comprising
leading at least two parallel pressure medium flows through the control valve and guiding the parallel pressure flows onto at least on working pressure surface of the percussion element to produce an impact pulse.

11. A method according to claim 8, comprising
leading at least two parallel pressure medium flows through the control valve away from at least one working pressure surface of the impact element to produce an impact pulse.

12. A method according claims 8, comprising
feeding pressure medium through a first control pressure channel at a substantially constant pressure into the first working pressure space,
and feeding pressure medium through a second control pressure channel at a substantially constant pressure into the second working pressure space.

13. A method according to claim 8, comprising
moving the elongated control element in the longitudinal direction.

14. A method according to claim 8, comprising
moving the control element in the direction of its periphery.

15. A percussion device for breaking rock, the percussion device comprising at least:
a frame;
an impact element, which is arranged in a space formed in the frame and comprises at least one working pressure surface, which is connected to at least one pressure medium channel, so that by affecting the pressure of a pressure medium directed at the working pressure surface, the impact element is arranged to produce impact pulses;
at least one control valve including a control element, which is movable back and forth and arranged to affect the feed of the pressure medium of at least one pressure medium channel leading to the impact element;
and where the control valve comprises:
at least a first working pressure space and a second working pressure space;
a first control pressure channel for feeding pressure medium into a first working pressure space;
a second control pressure channel for feeding pressure medium into the second working pressure space;
at least a first working pressure surface, which is arranged to move the control element in a first control direction due to the influence of the pressure medium acting on the first working pressure space;
and further at least a second working pressure surface, which is arranged to move the control element in a second control direction due to the influence of the pressure acting on the second working pressure space,
and when the control element of the control valve is moved in the first control direction from the middle position towards a first extreme position, the second working pressure space is arranged to close and form a closed pressure space, and correspondingly, when the control element is moved in the second control direction from the middle position towards a second extreme position, the first working pressure space is arranged to close and form a closed pressure space;
the pressure medium in the closed pressure space is arranged to compress and convert kinetic energy of the control element into pressure energy;
the pressure energy in the closed pressure space is arranged to be re-converted into kinetic energy when the control element changes its direction;
and the control valve is arranged to execute its working cycle without external control.

16. A percussion device according to claim 15, wherein
the working cycle of the control valve is provided with several connecting moments for opening and closing the pressure channels,
and one working cycle of the control valve from the first extreme position into the second extreme position and back is arranged to produce at least two impact pulses in the percussion device.

17. A percussion device according to claim 15, wherein
the control valve includes at least two parallel pressure channels where the flow direction of the pressure medium is the same, and the movement of the control element in one control direction is arranged to open a connection from the parallel pressure channels through the control valve substantially simultaneously.

18. A percussion device according to claim 15, wherein the impact element is a compression bar, the impact element is arranged to be pressed against the frame of the percussion device due to the influence of the pressure medium conveyed to the working pressure surface so that the impact element is arranged to compress longitudinally, and the control valve is arranged to quickly discharge the pressure medium acting on the working pressure surface so that the impact element resumes its original length and produces an impact pulse.

* * * * *